US008783589B2

(12) United States Patent
Hart et al.

(10) Patent No.: US 8,783,589 B2
(45) Date of Patent: Jul. 22, 2014

(54) GRINDING METHOD

(75) Inventors: Jarrod Hart, Los Olivos, CA (US); Thomas Parias, Atlanta, GA (US); David Robert Skuse, Truro (GB); Richard Tamblyn, Truro (GB); Mark Windebank, Par (GB); Jean-André Alary, L'Isle sur la Sorgue (FR)

(73) Assignee: Imerys, Paris (FR)

( * ) Notice: Subject to any disclaimer, the term of this patent is extended or adjusted under 35 U.S.C. 154(b) by 451 days.

(21) Appl. No.: 13/123,266

(22) PCT Filed: Oct. 8, 2009

(86) PCT No.: PCT/GB2009/051339

§ 371 (c)(1), (2), (4) Date: Jun. 15, 2011

(87) PCT Pub. No.: WO2010/041072

PCT Pub. Date: Apr. 15, 2010

(65) Prior Publication Data

US 2011/0233314 A1 Sep. 29, 2011

(30) Foreign Application Priority Data

Oct. 9, 2008 (EP) ..... 08166236

(51) Int. Cl.
*B02C 17/16* (2006.01)
*B02C 17/20* (2006.01)

(52) U.S. Cl.
CPC ..... *B02C 17/20* (2013.01); *B02C 17/16* (2013.01)
USPC ..... 241/21; 241/30; 241/184

(58) Field of Classification Search
CPC ..... B02C 17/16–17/168
USPC ..... 241/30, 184, 21
See application file for complete search history.

(56) References Cited

U.S. PATENT DOCUMENTS

| | | | |
|---|---|---|---|
| 1,398,970 | A | 12/1921 | Leddell |
| 2,978,850 | A | 4/1961 | Gleszer |
| 3,100,088 | A | 8/1963 | Podmore et al. |
| 3,239,970 | A | 3/1966 | Bishop |
| 3,356,302 | A | 12/1967 | Podmore |
| 3,428,443 | A | 2/1969 | Davis, Jr. |
| 3,568,251 | A | 3/1971 | Walker |
| 3,808,747 | A | 5/1974 | Kenagy |

(Continued)

FOREIGN PATENT DOCUMENTS

| | | |
|---|---|---|
| CA | 951911 | 7/1974 |
| CA | 990082 | 6/1976 |

(Continued)

OTHER PUBLICATIONS

Shi, F., "Comparison of grinding media—Cylpebs versus balls", Minerals Engineering 17, 2004, pp. 1259-1268.

(Continued)

*Primary Examiner* — Mark Rosenbaum
(74) *Attorney, Agent, or Firm* — Finnegan, Henderson, Farabow, Garrett & Dunner, L.L.P.

(57) ABSTRACT

A method of grinding a particulate material, comprising grinding said material in a stirred mill in the presence of a grinding media comprising rod-shaped particles, wherein said rod-shaped particles have an aspect ratio of equal to or greater than about 2:1.

21 Claims, 11 Drawing Sheets

(56) References Cited

U.S. PATENT DOCUMENTS

| | | | |
|---|---|---|---|
| 3,909,991 | A | 10/1975 | Coes, Jr. |
| 4,019,913 | A | 4/1977 | Weaver et al. |
| 4,101,079 | A | 7/1978 | Fikhte et al. |
| 4,403,742 | A | 9/1983 | Wu |
| 4,430,279 | A | 2/1984 | Hagio et al. |
| 4,695,294 | A | 9/1987 | Korzekwa et al. |
| 5,076,507 | A | 12/1991 | Graf |
| 5,957,398 | A | 9/1999 | Ogata et al. |
| 5,979,805 | A | 11/1999 | Angeletakis |
| 6,088,906 | A | 7/2000 | Hsu et al. |
| 6,309,749 | B1 | 10/2001 | Chatterjee et al. |
| 6,499,680 | B2 | 12/2002 | Schillaci |
| 6,604,698 | B2 | 8/2003 | Verhoff et al. |
| 7,267,292 | B2 | 9/2007 | Dobbs et al. |
| 2004/0170682 | A1 | 9/2004 | Dobetti et al. |
| 2008/0053657 | A1 | 3/2008 | Alary et al. |

FOREIGN PATENT DOCUMENTS

| | | | |
|---|---|---|---|
| CN | 2207879 | | 9/1995 |
| CN | 2664770 | | 12/2004 |
| CN | 2805931 | | 8/2006 |
| CN | 1864857 | A | 11/2006 |
| DE | 1577574 | A1 | 1/1970 |
| EP | 0 811 586 | A2 | 12/1997 |
| EP | 1 005 911 | A1 | 6/2000 |
| GB | 1155783 | | 6/1969 |
| GB | 1 366 100 | | 9/1974 |
| JP | 3016658 | A | 1/1991 |
| JP | 4293557 | A2 | 10/1992 |
| JP | 5253512 | A2 | 10/1993 |
| JP | 6126204 | A2 | 5/1994 |
| JP | 7073680 | B4 | 8/1995 |
| JP | 10085619 | A | 4/1998 |
| JP | 11226439 | A | 8/1999 |
| JP | 2001-276639 | A | 10/2001 |
| KR | 10-20050085035 | A | 8/2005 |
| RU | 2024312 | C1 | 12/1994 |
| RU | 2311960 | | 12/2007 |
| WO | WO 01/85345 | A1 | 11/2001 |
| WO | WO 03/002259 | A1 | 1/2003 |
| WO | WO 03/045564 | A1 | 6/2003 |
| WO | WO 2004/045585 | A1 | 6/2004 |
| WO | WO 2010/041072 | A1 | 4/2010 |

OTHER PUBLICATIONS

Lameck, N.S.; Kiangi, K.K., and Moys, M.H., "Effects of grinding media shapes on load behaviour and mill power in a dry ball mill", Minerals Engineering 19, 2006, pp. 1357-1361.

Kelsall, D.F.; Stewart, P.S.B., and Weller, K.R., "Continuous grinding in a small wet ball mill. Part V. A study of the influence of media shape", Powder Technology, 8, 1973, pp. 77-83.

Ipek, H., "The effects of grinding media shape on breakage rate", Minerals Engineering 19, 2006, pp. 91-93.

Ipek, Halil, "Effect of Grinding Media Shapes on Breakage Parameters", Part. Part. Syst. Charact. 24, 2007, pp. 229-235.

Yildirim, K., and Austin, Leonard G., "The abrasive wear of cylindrical grinding media", WEAR 218, 1998, pp. 15-20.

Lameck, N.S., and Moys, M.H., "Effects of media shape on milling kinetics", Minerals Engineering 19, 2006, pp. 1377-1379.

International Search Report and Written Opinion issued Jan. 18, 2010, in International Application No. PCT/GB2009/051339, filed Oct. 8, 2009.

European Search Report issued Mar. 27, 2009, in related EP Application No. 08166236.3, filed Oct. 9, 2008.

Wu, BL; Zhang, H; Xie, Jr., Duan XL; Lin HJ; Li, GD, "A new technology of preparing alumina ceramic grinding media," Industrial Ceramics, vol. 20 Issue 3, 2000, pp. 195-197.

Luo, Chun-mei; Xiao, Qing-fei; Guo, Yong-jie; Duan, Xi-xiang, "Selection on Fine Grinding Media Shape of Tin Ore," Journal of Kunming University of Science and Technology, vol. 33, No. 1, No. 6, Feb. 2008.

Office Action for related Chinese Application No. 200980144763.0, issued Dec. 4, 2012.

GRINDING METHOD

This application is a U.S. national stage entry under 35 U.S.C. §371 from PCT International Application No. PCT/GB2009/051339 filed Oct. 8, 2009, and claims priority to and the benefit of the filing date of EP Application No. 08166236.3, filed Oct. 9, 2008, the subject matter of both of which is incorporated herein by reference.

The present invention relates to a method of reducing the particle size of a particulate material by grinding said material in a stirred mill in the presence of a grinding media comprising rod-shaped particles having an aspect ratio of equal to or greater than about 2:1.

BACKGROUND OF THE INVENTION

Grinding is a key process in mineral ore dressing and in particle processing in general, and is often carried out in a grinding mill in the presence of a grinding medium.

An important consideration in any grinding process is the amount of energy that is required to grind the material being ground to a particular fineness of grind. This is important because efficiency gains translate directly into cost and environmental savings.

A number of different factors can at any one time affect the amount of energy that is required to grind a particulate material to any given particle size. These factors include the properties of the mineral (hardness, fracture habit, etc.) type of mill (e.g., tumbling, vibratory, stirred, etc.), the grinding process conditions (e.g., dry or wet), the form of the grinding medium (e.g., the composition and physical shape of the particles comprised in the medium) and the form of the material being ground (e.g., slurry/material mix). It is not readily predictable how the modification of any one of these factors will affect the efficiency of the overall grinding process.

Aspects of the known grinding processes are discussed in the patent and academic literature, and in this respect, a number of studies have focussed on the form the grinding media should take.

Lameck et al in '*Effects of grinding media shapes on load behaviour and mill power in a dry ball mill*', Minerals Engineering 19 (2006) 1357-1361, investigated the effects of grinding media shape (cylpebs, spherical and worn balls) on load behaviour and mill power draw at various mill speeds and load filling. The authors concluded that spheres require higher energy input than cylpebs, but that this effect is probably only relevant in tumbling mills, where interlocking packing is a barrier to energy transfer.

In Shi, F., '*Comparison of grinding media-Cylpebs versus balls*', Minerals Engineering 17 (2004) 1259-1268, laboratory tests were conducted using a standard Bond ball mill to compare the milling performance of cylpebs (a slightly tapered cylindrical media with a length to diameter ratio of unity) against balls. It was found that cylpebs produce a similar product at the fine end compared with balls at identical charge mass and at the identical specific energy input level.

U.S. Pat. No. 4,695,294 discloses a grinding mixture comprising silicon carbide pellets having a maximum dimension of from 5 to 50 mm and a suspension of silicon carbide powder which is suitable for use in a vibratory mill. The silicon carbide pellets may have a cylindrical shape and the diameter of the cylinder may be from 0.3 to 3 times the length of the cylinder. The grinding media is described as having good resistance to degradation during grinding of silicon carbide powders by vibration, and can be used to grind silicon carbide without contamination.

In a similar manner, U.S. Pat. No. 7,267,292 describes a grinding media including shaped media such as spheres or rods ranging in size from about 0.5 um to 100 mm in diameter, which are formed from a multi-carbide material consisting essentially of two or more carbide-forming elements and carbon. The media are said to have extremely high mass density, extreme hardness and extreme mechanical toughness.

WO-A-2001/085345 describes a grinding media in the form of non-spherical shapes such as cylindrical and toroidal shapes, and combinations of grinding media with different shapes and sizes.

EP-A-1406728 describes a process for the preparation of a drug carrier composite by grinding a drug-carrier mixture in a vibratory mill in the presence of a grinding media of cylindrical shape having a dimensional ratio (diameter to height) of between 0.5 and 2. The process is said to lead to a drug having a high and constant degree of activation.

From a cost and environmental perspective, there is an ongoing need for the development of grinding processes which require less energy to grind materials to any given particle size.

As discussed in more detail below, the present inventors have surprisingly found that the amount of energy required to grind a particulate material in a stirred mill to a pre-determined particle size distribution (for example as defined by the $d_{50}$) can be reduced by using a grinding media comprising rod-shaped particles having an aspect ratio of equal to or greater than 2:1.

SUMMARY OF THE INVENTION

In accordance with a first aspect, the present invention is directed to a method of grinding a particulate material, comprising grinding said material in a stirred mill in the presence of a grinding media comprising rod-shaped particles, wherein said rod-shaped particles have an aspect ratio of equal to or greater than about 2:1.

In accordance with a second aspect, the present invention is directed to the use of a grinding media comprising rod-shaped particles having an aspect ratio of equal to or greater than 2:1 in a stirred mill to grind a particulate material in a stirred mill.

It has been surprisingly found that the amount of energy required to grind the particulate material in a stirred mill to a pre-determined particle size distribution (for example as defined by the $d_{50}$) is reduced when using a grinding media comprising rod-shaped particles having an aspect ratio of equal to or greater than 2:1, compared to the grinding media currently used in stirred mills.

DETAILED DESCRIPTION OF THE INVENTION

Figure 1:
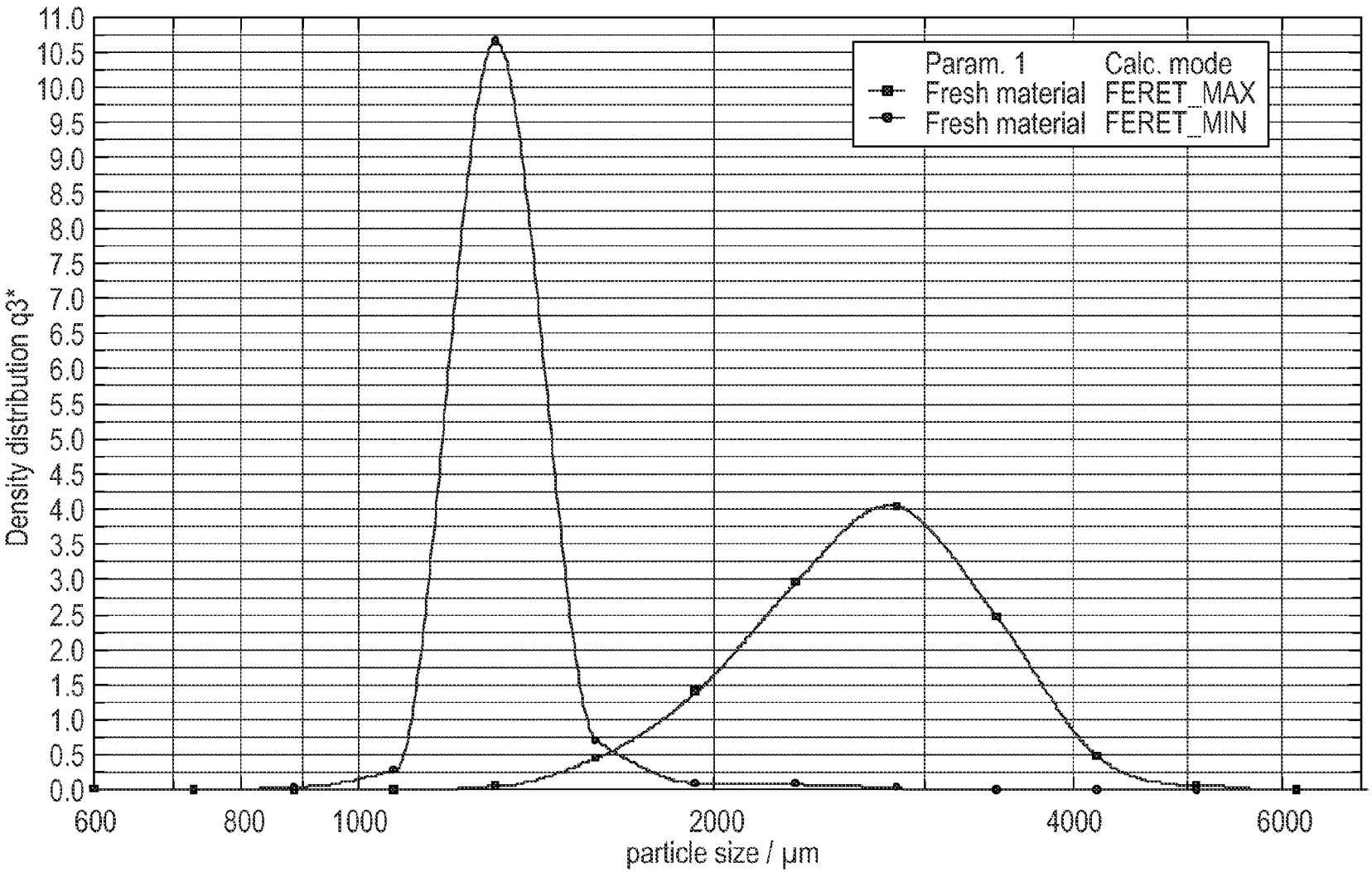
FIG. 1 is a graphing showing the particle size analysis of the Carrara flour used in Examples 1 and 2.

As stated above, the present invention relates to a method for grinding a particulate material, comprising grinding said material in a stirred mill in the presence of a grinding media comprising rod-shaped particles having an aspect ratio of equal to or greater than about 2:1.

The rod-shaped particles are solid bodies which have an axis running the length of the body about which an outer surface is defined, and opposite end surfaces. The outer surface and the opposite end surfaces together define the body.

In embodiments of the invention, the lengthwise axis is substantially rectilinear, by which we mean that the line representing the shortest distance between the two ends falls completely within the body. In other embodiments, the rod-shaped particles may take an arcuate form in which the axis is curvilinear and the line representing the shortest distance does not fall completely within the body. Mixtures of rod-shaped bodies having a rectilinear axis and bodies having an arcuate form are contemplated, as are embodiments in which substantially all (for example 90% by weight or 95% by weight or 99% by weight) of the rod-shaped particles of aspect ratio of 2:1 or more either have the rectilinear form or have the arcuate form. Rod-shaped particles of the rectilinear form are currently preferred.

In an embodiment, the cross section of the rod-shaped particles is substantially constant along the length of the particle. By "substantially constant" is meant that the major dimension of the cross-section does not vary by, for example, more than 20% or by more than 10% or by more than 5%.

In another embodiment, the cross-section of the rod-shaped particles varies along the length of the particle by, for example, by more than 20%. For example, the body of the rod-shaped particle may take the form of a barrel in which the cross-section at each of the ends of the body of the particle is less than a cross-section measured between the ends; or for example, the body of the rod-shaped particle may take the form of an inverse barrel in which the cross-section at each of the ends of the particle is greater than a cross-section measured between the ends.

The cross-sectional shape of the rod-shaped particles may be symmetrical or asymmetrical. For example, the cross-sectional shape may be circular or substantially circular, or may be substantially ovoid. Other shapes include angular shapes such as triangles, squares, rectangles, stars (five and six-pointed), diamonds, etc.

The boundary between the outer lengthwise surface and the opposite end surfaces may be angular, i.e. having a discrete sharp boundary, or non-angular, i.e. being rounded or radiused. The end surfaces may be flat, convex or concave.

As previously noted, the aspect ratio of the rod-shaped particles is 2:1 or more than 2:1. The aspect ratio is to be understood as the ratio of the longest dimension of the particle to the shortest dimension. For purposes of the present invention, the longest dimension is the axial length of the rod-shaped particles. Where the particle has a constant cross-section along its length, the shortest dimension for purposes of defining the aspect ratio is the largest dimension of the cross-section which passes through the geometric centre of the particle cross-section. Where the cross-section varies along the length of the particle, the shortest dimension for purposes of defining the aspect ratio is the largest dimension at the point at which the cross-section is at a maximum. Where the particle has an irregular shaped cross-section, the shortest dimension for the purposes of defining the aspect ratio is the maximum transverse dimension perpendicular to the axis of the rod-shaped particle.

An example of suitable rod-shaped particles for use in the invention are particles having a substantially rectilinear axis and a substantially circular cross-section. Another example of suitable rod-shaped particles for use in the invention are particles having a arcuate form and a substantially circular cross-section. In both these examples, the boundary between the outer lengthwise surface and the opposite end surfaces is rounded and the ends are generally flat or convex.

In embodiments, the rod-shaped particles have an aspect ratio of 3:1 or more than 3:1, or an aspect ratio of 4:1 or more than 4:1, or an aspect ratio of 5:1 or more than 5:1, or an aspect ratio of 6:1 or more than 6:1.

The aspect ratio may be 10:1 or less than 10:1, or may be 9:1 or less than 9:1 or may be 8:1 or less than 8:1 or may be 7:1 or less than 7: or may be 6:1 or less than 6:1 or may be 5:1 or less than 5:1.

The aspect ratio may be in the range of from 2:1 to 10:1 or may be in the range of from 2:1 to 5:1 or may be in the range 3:1 to 8:1 or may be in the range of from 3:1 to 6:1

In other embodiments, the axial length of the rod-shaped particles is between about 1 mm and about 5 mm, or between 2 mm and 4 mm. In another embodiment, the rod length is less than about 3 mm.

In an embodiment, the grinding media may comprise (i.e., in addition to the rod-shaped particles having an aspect ratio of 2:1 or more) other particles selected from rod-shaped particles having an aspect ratio less than 2:1 and particles having other shapes such as spheres, cylpebs, cubes, discs, toroids, cones, and the like. For example, the grinding media may comprise at least 10% by weight of rod-shaped particles having an aspect ratio of 2:1 or more, or may comprise at least 20% by weight of rod-shaped particles having an aspect ratio of 2:1 or more, or may comprise at least 30% by weight of rod-shaped particles having an aspect ratio of 2:1 or more, or may comprise at least 40% by weight of rod-shaped particles having an aspect ratio of 2:1 or more, or may comprise at least 50% by weight of rod-shaped particles having an aspect ratio of 2:1 or more, or may comprise at least 60% by weight of rod-shaped particles having an aspect ratio of 2:1 or more, or may comprise at least 70% by weight of rod-shaped particles having an aspect ratio of 2:1 or more, or may comprise at least 80% by weight of rod-shaped particles having an aspect ratio of 2:1 or more, or may comprise at least 90% by weight of rod-shaped particles having an aspect ratio of 2:1 or more, or may comprise essentially only (e.g. 95% by weight or more) rod-shaped particles having an aspect ratio of 2:1 or more. It will be further understood that in embodiments of the invention, a relatively small number of rod-shaped particles having an aspect ratio smaller than 2:1 may be present as a by-product of the process by which the particles are made or handled. Similarly, rod-shaped particles having a relatively high aspect ratio such as, for example, greater than about 10:1, may be added to the grinding process, in which case these rods may snap to their own preferred length during the grinding process.

Figure 4A:
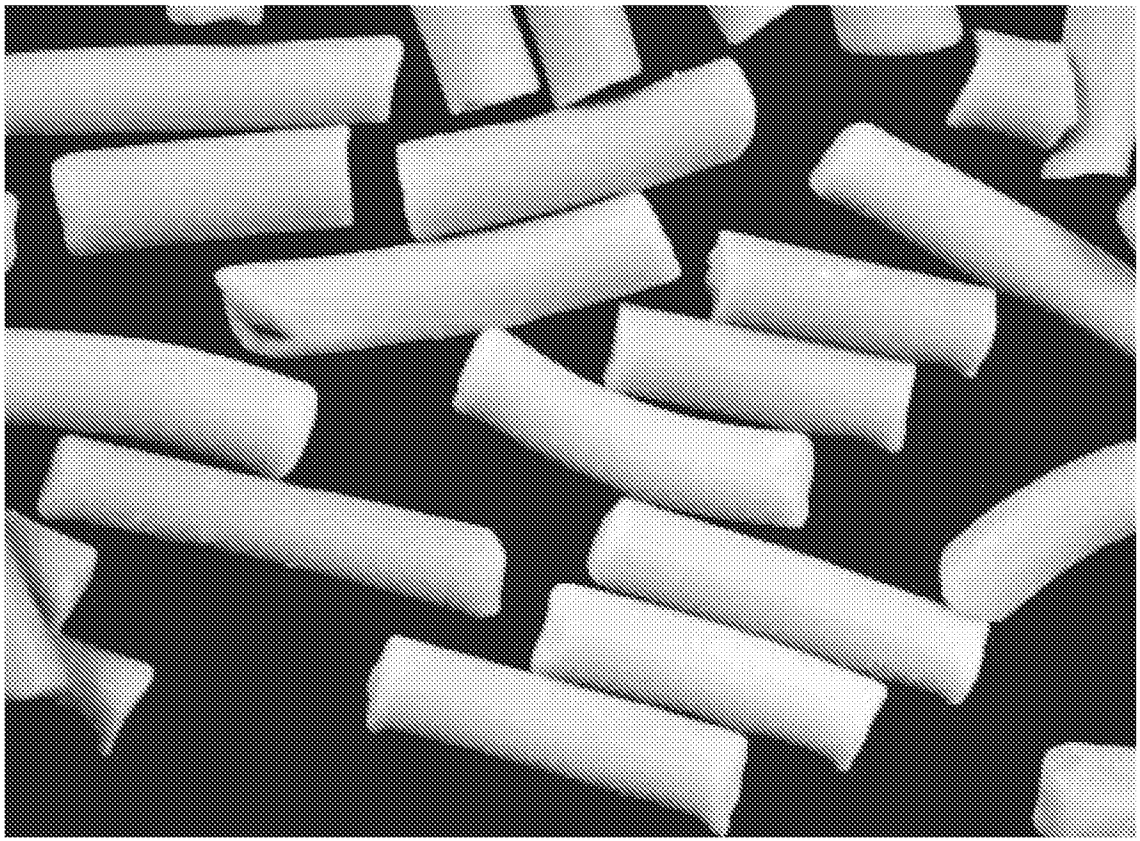
FIGS. 4*a* and 4*b* are microscope images showing rod-shaped particles having an aspect ratio of 2:1 or more (length less than 3 mm) prior to grinding. The field of view is 9 mm (FIG. 3*a*) and 6 mm (FIG. 3*b*).
Figure 4B:
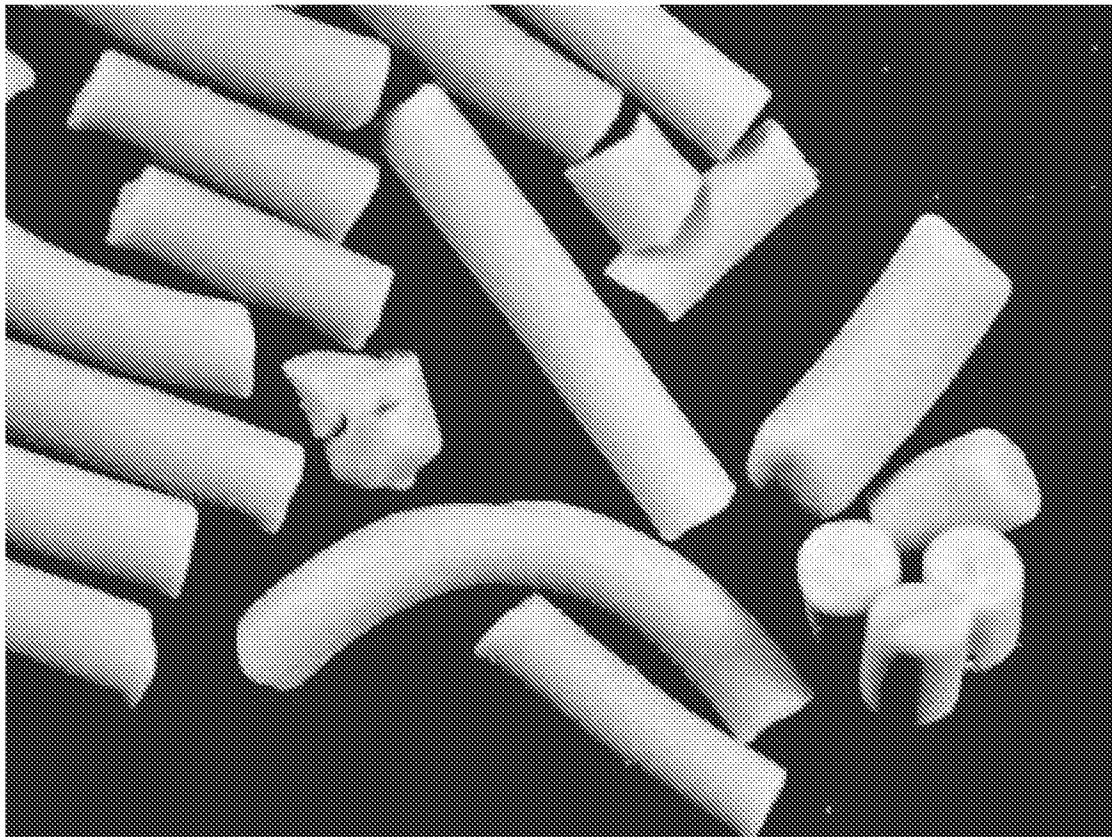
Figure 5:
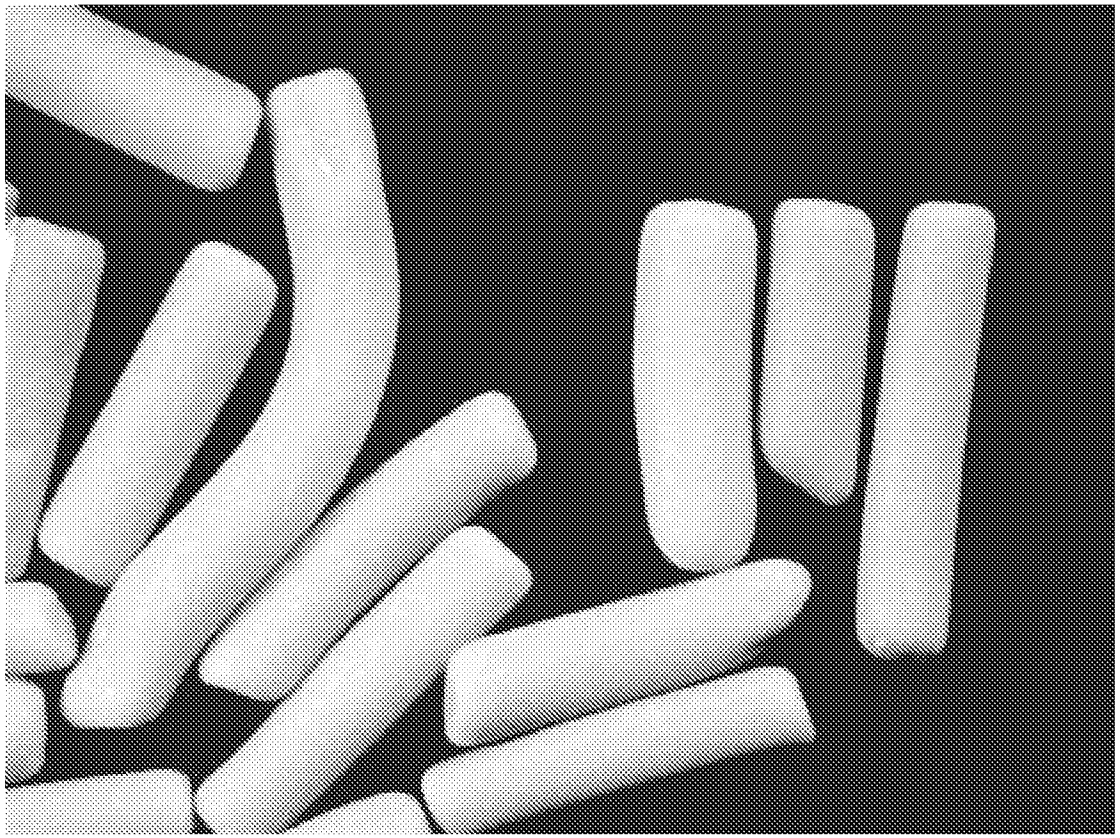
FIG. 5 is a microscope image of the rod-shaped particles illustrated in FIGS. 4*a* and 4*b* after exposure to the grinding environment.

It will also be understood that as the grinding process progresses the shape of at least some of the rod-shaped particles will evolve such that the ends round off (for example, as shown in FIG. 4), and the aspect ratio lowers, and in some cases the virgin rod-shaped particles may eventually become small spheres, so a typical mature grinder may contain rods, worn rods and even spheres. Thus, a "worked-in" sample of rod-shaped particles which originally had an aspect ratio at least 2:1 or more may contain a majority (if worked long enough) of particles somewhat different in shape to the rod-shaped particles comprised in the virgin media. The grinder may be topped up with fresh media comprising rod-shaped particles having an aspect ratio of 2:1 or more.

The rod-shaped particles used in the invention are formed of a dense, hard mineral, ceramic or metallic material suitable for use as a grinding media. In an embodiment, the rod-shaped particles are a sintered ceramic material. In another embodiment, the rod-shaped particles are formed from zirconia in whole or in part. For example, the rod-shaped particle may be formed of yttria, ceria, zirconia silicate or magnesia stabilized zirconia. In another embodiment, the rod-shaped particles are formed from mullite. In another embodiment, the rod-shaped particles are formed from blends of mullite and corundum or silicate.

The rod-shaped particles may be prepared by methods generally known in the art. For example, the particles may be made by sintering an alumina-containing material, such as, for example, technical grade alumina, bauxite or any other suitable combination of oxides thereof. The sintered rod is found to exhibit superior hardness and toughness and, as is known in the art, increased alumina content in the sintered product can lead to increased hardness and toughness.

In some embodiments, the alumina content of the sintered rod-shaped particles is greater than about 30 weight % based on the total weight of rod-shaped particles, or greater than about 40 weight %, or greater than about 50%, or greater than about 60%, or greater than about 70%, or greater than about 80%, or greater than about 90 weight %, or equal or greater than about 92 weight %, or greater than about 95 weight %.

The sintered rod-shaped particles may contain between about 0.2 weight % and 4 weight % aluminum titanate ($Al_2TiO_5$), between about 0.5 weight % and 3 weight % aluminum titanate, or between about 1 weight % and 2.5 weight % aluminum titanate.

The sintered rod-shaped particles may also be formulated to restrict there $SiO_2$ content to a specific low level, e.g., less than about 4 weight %, and preferably no more than about 2 weight %.

The sintered rod-shaped particles may contain no more than 10 weight percent iron oxide, and preferably no more than 8 weight % iron oxide.

Methods for conditioning alumina-containing material suitable prior to the preparation of the rod-shaped particles are described in US 2008/0053657 A1, the contents of which is incorporated herein by reference in its entirety.

The rod-shaped particles may be prepared by first mixing the desired alumina-containing materials with at least one binding agent and/or solvent. The binding agent and/or solvent is one of those well known in the industry. Possible binding agents include, for example, methyl cellulose, polyvinyl butyrals, emulsified acrylates, polyvinyl alcohols, polyvinyl pyrrolidones, polyacrylics, starch, silicon binders, polyacrylates, silicates, polyethylene imine, lignosulfonates, alginates, etc. Possible solvents may include, for example, water, alcohols, ketones, aromatic compounds, hydrocarbons, etc. Other additives well known in the industry may be added as well. For example, lubricants may be added, such as ammonium stearates, wax emulsions, oleic acid, Manhattan fish oil, stearic acid, wax, palmitic acid, linoleic acid, myristic acid, and lauric acid. Plasticizers may also be used, including polyethylene glycol, octyl phthalates, and ethylene glycol. The mixture may then be extruded, for example, through a die, to form a rod having a cross-section of a desired shape, such as a substantially circular shape or any other suitable shape. The process of extrusion may be performed using extrusion methods known in the industry. For example, the extrusion process may be a batch process, such as by forming the rods using a piston press, or may be a continuous process using an extruder containing one or more screws. Loomis manufactures a piston press that may be used to batch produce the rods, while Dorst and ECT both make extruders that contain one or more screws that may be used in the continuous extrusion production method. Other suitable equipment and manufacturers will be readily ascertainable to those of skill in the art.

The extruded rod-shaped particles are then dried, for example, at about 50° C. or any other effective temperature, and reduced to the desired rod length, as needed. Any suitable drying process known to the industry may be used. For example, the rod-shaped particles may be dried using electric or gas driers. The drying process may be performed by microwave, with a continuous drying process being preferred. The reduction to the desired length may be achieved through cutting using, for example, a rotating blade, a cross cutter, a strand cutter, a longitudinal cutter, a cutting mill, a beating mill, a roller, or any other suitable reducing mechanism. The reduction to the desired length may occur as a result of the drying process. Alternatively, rod-shaped particles having the desired length may be obtained by any one of various selection methods known to those skilled in the art, including visual or mechanical inspection, or sieving. However, classical sieving methods tend to break the weaker rods. This is not necessarily a disadvantage, as only the stronger rods are selected by sieving. The appropriate selection method will need to be determined on a case-by-case basis, and will depend on the goal of the selection process.

The formed rod-shaped particles may then be sintered, for example at about 1300° C. to about 1700° C. to form the sintered rod-shaped particles suitable for use as a grinding media. The sintering temperature may be between about 1400° C. to about 1600° C. The sintering equipment may be any suitable equipment known in the industry, including, for example, rotary or vertical furnaces, or tunnel or pendular sintering equipment.

In the presently described grinding method a particulate material is ground to a desired particle size distribution.

All particle size values pertaining to the materials being ground are specified as equivalent spherical diameters, and are measured by either of the following two methods. One method is the well known method employed in the art of sedimentation of the particles in a fully dispersed state in an aqueous medium using a SEDIGRAPH 5100 machine as supplied by Micromeritics Corporation, USA.

In the second method particle size is measured using a Malvern Particle Size Analyzer, Model Mastersizer, from Malvern Instruments. A helium-neon gas laser beam is projected through a transparent cell which contains the particles suspended in an aqueous solution. Light rays which strike the particles are scattered through angles which are inversely proportional to the particle size. The photodetector array measures the quantity of light at several predetermined angles. Electrical signals proportional to the measured light flux values are then processed by a microcomputer system, against a scatter pattern predicted from theoretical particles as defined by the refractive indices of the sample and aqueous dispersant to determine the particle size distribution.

The term "$d_{50}$" used herein refers to the particle size value less than which there are 50% by weight of the particles. The term $d_{90}$ is the particle size value less than which there are 90% by weight of the particles.

The particulate material may be an inorganic material, which may comprise a metallic element.

The particulate material may comprise one or more minerals. Such minerals include silicates, carbonates, oxides, hydroxides, sulfides, sulfates, borates, phosphates, halides and the like. Specific minerals include an alkaline earth metal carbonate (for example, calcium carbonate), silica, a clay mineral such as kaolinite, talc gypsum, mica, wollastonite, quartz, bauxite, magnesium carbonate, andalusite, barite, diatomaceous earth and dolomite. In an embodiment, the particulate material is an alkaline earth metal carbonate, for example a calcium carbonate. In another embodiment, the particulate material to be ground is kaolinite.

In an embodiment, the particulate material to be ground is a metal ore. For example, the metal ore may be selected from Acanthite, Barite, Bauxite, Beryl, Bornite, Cassiterite, Chalcocite, Chalcopyrite, Chromite, Cinnabar, Cobaltite, Columbite-Tantalite or Coltan, Galena, Gold, Hematite, Ilmenite, Magnetite, Molybdenite, Pentlandite, Pyrolusite, Scheelite, Sphalerite and Uraninite.

In an embodiment in which white minerals, such as calcium carbonate and kaolinite are ground, the grinding process may impart various desirable optical properties to the composition, such as colour and brightness. For example, a particulate calcium carbonate or kaolinite ground in accordance with the present invention to a desired particle size may have a brightness of at least 80%, or at least about 90%, or at least about 91%, or at least about 92%, or at least about 93%, or at least about 93.5%, or at least about 94%, or at least about 94.5%, or at least about 95%, and may have a yellowness of at about 1.0, or equal to or less than about 1.1, or equal to or less than about 1.2, or equal to or less than about 1.3, or equal to or less than about 1.5, or equal to or less than about 2.0, or equal to or less than about 2.5.

For the purpose of the present application "brightness" is defined as the percentage of light reflected by a body compared to that reflected by a perfectly reflecting diffuser measured (in accordance with ISO 2470:1999) at a nominal wavelength of 457 nm with a Datacolour Elrepho or similar instrument such as the Carl Zeiss photoelectric reflection photometer. Yellowness is the difference between the percentage of light reflected by a body compared to that reflected by a perfectly reflecting diffuser measured at a nominal wavelength of 571 nm and the brightness value described above.

The particulate material being ground will typically be in the form of a slurry expressed as the % solids by weight (100-% moisture). For example, the slurry may have a solids content of at least about 5% by weight, at least about 10% by weight, at least about 20% by weight, at least about 30% by weight, at least about 40% by weight, at least about 50% by weight, at least about 60% by weight, at least about 70% by weight, or at least about 75% by weight.

In embodiments, the particulate material is in the form of a slurry and the grinding media comprising rod-shaped particles and the slurry are present in the stirred mill at a media to slurry ratio (volume based) ranging from about 10:90 to 90:10, or from about 20:80 to 80:20, or from about 30:70 to 70:30, or from about 40:60 to about 60:40, or from about 55:60 to about 60:40, for example, from about 55:60 to 60:55. In other embodiments, the media to slurry ratio ranges from about 45:55 to 55:45, from about 48:52 to 52:48, or from about 49:51 to 49:51.

The mill utilized in the method of the invention is a stirred mill (also known as a stirred media mill where—as in the invention—a grinding media is present). A stirred mill is a grinding mill in which the mill shell, having an orientation ranging between horizontal and vertical, is stationary and the motion is imparted to the material being ground by the movement of an internal stirrer. Grinding media inside the mill are agitated or rotated by a stirrer, which typically comprises a central shaft to which are attached pins, discs or impellers of various designs. Stirred mills typically find application in fine (15-40 μm) and ultra-fine (<15 μm) grinding. For the avoidance of doubt, a stirred media detritor is considered a stirred mill for the purposes of the present invention, the impellers of the device functioning to stir or intermix the feed and grinding media. For vertical stirred mills, grind energy density is typically 50-100 $kW/m^3$, whilst for horizontal stirred mills the grind energy density is typically 300-1000 $kW/m^3$. Further information about the design of stirred mills may be found in the textbook "Wills' Mineral Processing Technology", $7^{th}$ Edition, Chapter 7, the contents of which are herein incorporated by reference for all purposes.

The stirred mill utilised in the methods of the present invention may be a tower mill, a Sala agitated mill (SAM), an ISA mill (manufactured by Xstrata Technology and Netzsch) or a stirred media detritor (SMD) (manufactured by Metso Minerals).

In one embodiment, the stirred mill is an ISA mill. In another embodiment, the stirred mill is a stirred media detritor (SMD).

Vertical (e.g. SAM) and horizontal (e.g. ISA mill) employ stirrers comprising a shaft with pins or disks.

As discussed above, the SMD mill employs impellers rotating at relatively low speed. Typically, grinding media is added through a pneumatic feed port or manual feed chute located at the top of the mill, and the feed slurry enters through a port in the top of the unit.

The general grinding conditions used in the methods of the present invention are conventional and well known in the art.

The energy input in a typical slurry grinding process to obtain the desired particulate material will vary depending on the material being ground and the desired particle size. However, as discussed above, the present inventors have found that the amount of energy required to grind, in a stirred mill, a particulate material to a pre-determined particle size (e.g. as may be defined by the $d_{50}$) can be reduced when using a grinding media comprising rod-shaped particles having an aspect ratio of equal to or greater than 2:1, compared to grinding media currently used in stirred mills, such as, for example, Carbolite® ceramic grinding media (16/20).

The required energy input will differ from case to case, and depend upon the initial size of the feed material and the desired fineness of grind. Generally speaking, it will not often be necessary for the energy input to exceed about 2000 $kWht^{-1}$, in order to produce useful fine particulate material.

The slurry of solid material to be ground may be of a relatively high viscosity, in which case a suitable dispersing agent may preferably be added to the suspension prior to comminution by the method of the invention. The dispersing agent may be, for example, a water soluble condensed phosphate, a water soluble salt of a polysilicic acid or a polyelectrolyte, for example a water soluble salt of a poly(acrylic acid) or of a poly(methacrylic acid) having a number average molecular weight not greater than 80,000. The amount of the dispersing agent used may be in the range of from 0.1 to 2.0% by weight, based on the weight of the dry particulate solid material. The suspension may suitably be ground at a temperature in the range of from 4° C. to 100° C.

The grinding is continued until the desired particle diameter is achieved, after which the particulate material may be dried. Drying can be accomplished via use of spray driers, flash dryers, drum dryers, shelf or hearth dryers, freeze driers and drying mills, or some combination thereof.

The final grinding may be preceded by a dry grinding step in which the coarse pre-cursor material is dry ground to an intermediate particle size greater than the final desired particle size. For example, in this preliminary coarse grinding step, the material may be ground such that it has a particle size distribution in respect of which the $d_{50}$ is less than about 20 μm. This dry, coarse grinding step may, for example, be carried out by dry ball-milling with a ceramic grinding media. Alternatively, grinding may be by high-compression roller, fluid energy mill (also known as jet mill) or hammer mill.

The coarse material for the dry grinding step may itself be provided by crushing raw material using well known procedures. For example, crushing may be performed using jaw-crushing, for example to reduce the size of the material fragments to less than about 2 mm, for example.

Either before, or at some stage of, the crushing and grinding process, the material is preferably washed free of fine debris which might otherwise contribute to poor brightness and tint. Typically, this washing is carried out on the shards of raw material using a washing medium comprising water. The washing step may comprise cleaning the shards of raw material with a solvent, such as an organic solvent, an acid, a base, or the like.

A number of additional beneficiation steps may be used to improve brightness and tint. For example, during the crushing or grinding process, the material may be subjected to bleaching, leaching, magnetic separation, classification, froth flotation, and the like.

The invention will now be illustrated, by reference to the following non-limiting Examples.

EXAMPLES

Example 1

Grinding experiments (laboratory scale) were conducted using a small lab sand grinder, according to the following composition:

750 g Carrara flour (calcium carbonate)
250 g water
grinding media (normalised by density, dependent on slurry:media ratio)
0.6 wt. % polyacrylate dispersant The Carrara flour had the following particle size distribution as measured by Sedigraph: $d_{30}$ of 7.91; $d_{50}$ of 27.10; $d_{70}$ of 29; 9.5% of particles less than 2 μm; 16.72% of particles less than 1 μm.

The grinding media tested were:

(A) rod-shaped particles (containing 92% alumina, made from sintered bauxite) having an aspect ratio greater than 2:1
(B) spherical particles having a median particle diameter of about 0.7 mm (sintered bauxitic clay—51 wt % alumina/45 wt % silica);
(C) spherical particles having a median particle diameter of about 0.7 mm (sintered bauxite—83 wt % alumina/5 wt % silica)

Size analysis of media (A) was conducted using QICPIC equipment form Sympatec. Measurement is based on dynamic image analysis of rapid exposure images of the equipment. Results are shown in FIG. 1.

The Feret Max diameter gives a good estimation of the length distribution, whilst Feret Min gives a good rod diameter distribution.

The rotor speed was kept at 600 rpm so as to prevent the motor 'tripping' from excessive power draw. The grinding results obtained are summarised in Table 1 below.

TABLE 1

| Media | A | A | A | B | C |
|---|---|---|---|---|---|
| (vol.) % media | 51 | 50 | 49 | 51 | 52 |
| Total time (min) | 36 | 37 | 40 | 95 | 75 |
| Final % solids | 76.0 | 75.4 | 78.8 | 75.9 | 76.2 |
| % < 2 μm (Sedigraph) | 84 | 83 | 78 | 71 | 77 |
| % < 1 μm (Sedigraph) | 56 | 55 | 52 | 52 | 55 |
| Surface area ($m^2/g$) | 11.7 | 11.0 | 9.9 | 8.5 | 9.1 |
| Steepness[a] | 32.1 | 31.8 | 30.1 | 33.8 | 29.3 |
| Brightness[b] | 93.8 | 94.4 | 93.8 | 95.0 | 92.1 |
| Yellowness | 1.0 | 1.0 | 1.1 | 1.2 | 2.2 |

[a]steepness is $d_{70}/d_{30}$;
[b]ISO 2470:1999

It can be seen that the rod-shaped media has a higher grinding efficiency at the appropriate conditions over the spherical media.

The use of the rod-shaped material produces a higher surface area, whilst also maintaining the steepness of the particle size distribution.

Example 2

Further experiments (laboratory scale) were conducted using a small lab sand grinder, according to the following composition:

750 g Carrara flour (calcium carbonate) as used in Example 1
321 g water
grinding media (normalised by density, dependent on slurry:media ratio)
0.6 wt. % polyacrylate dispersant The grinding media tested were:

(D) rod-shaped particles (containing 96% alumina, made from sintered bauxite) having an aspect ratio greater than 2:1
(E) spherical particles having a median particle diameter of about 1.3 mm (sintered bauxitic clay—51 wt % alumina/45 wt % silica)

(F) spherical particles having a median particle diameter of about 1.0 mm (sintered bauxitic clay—51 wt % alumina/45 wt % silica)

(G) spherical particles having a median particle diameter of about 0.7 mm (sintered bauxitic clay—51 wt % alumina/45 wt % silica)

Figure 2:
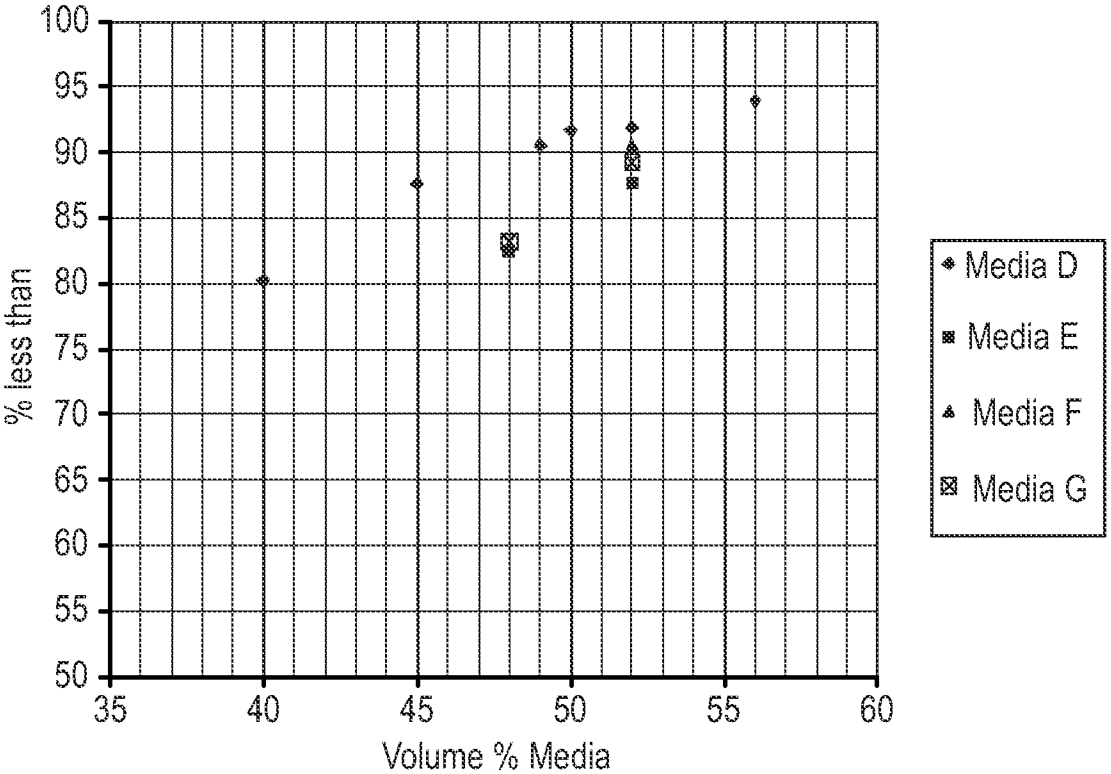
FIG. 2 is a graph showing the percentage of particulate calcium carbonate ground (with an energy input of 150 kw h/t) to a $d_{50}$ less than 2 μm using a grinding media comprising rod-shaped particles and a grinding media comprising a conventional grinding media.
Figure 3:
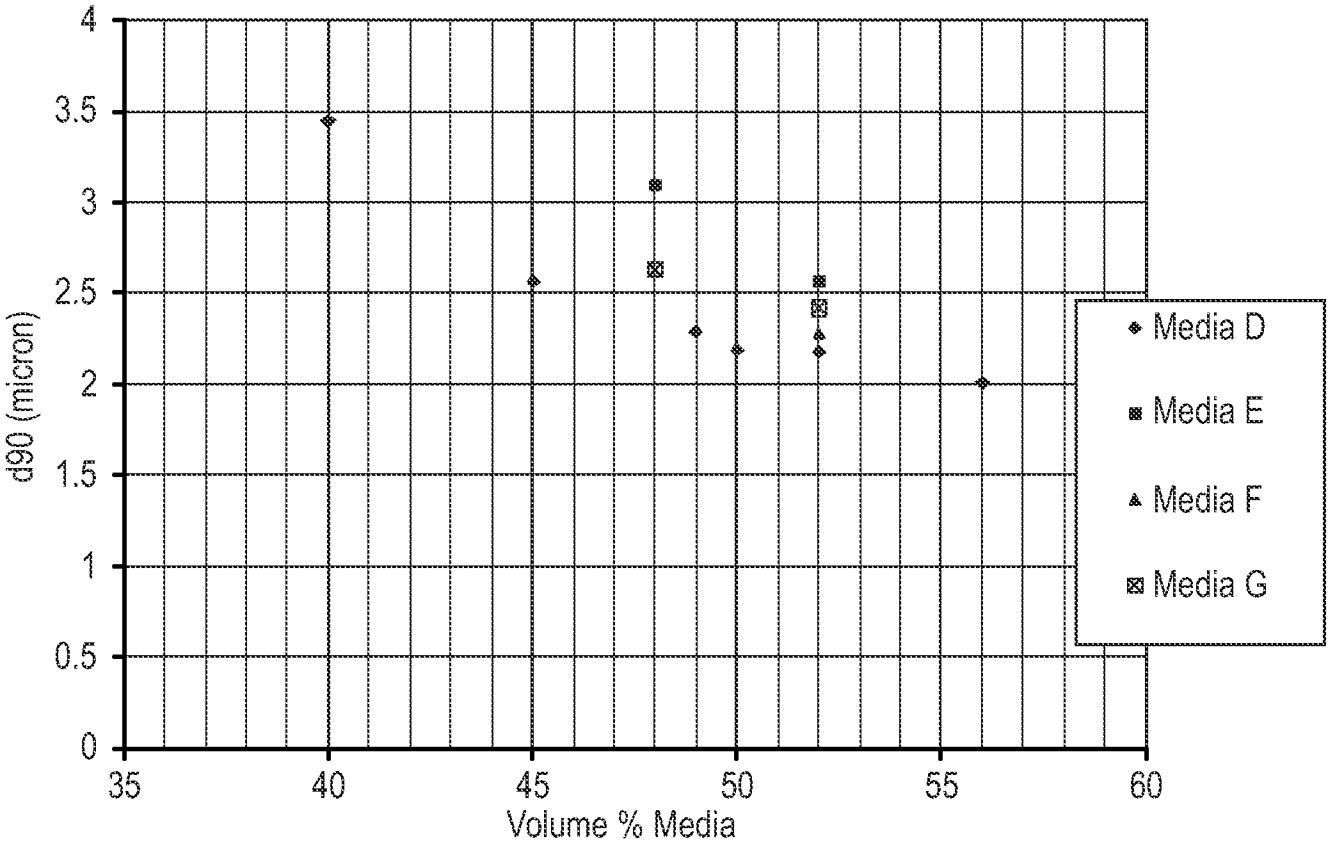
FIG. 3 is a graph showing the $d_{90}$ (in microns) of a particulate calcium carbonate ground (with an energy input of 150 kw h/t) using a grinding media comprising rod-shaped particles and a grinding media comprising a conventional grinding media.

In all cases, samples were ground to 150 kWh/t, and size distributions measured by Malvern. The grinding conditions and results obtained are summarised in Table 1. FIG. 2 and FIG. 3. Particle size measurements were taken by Malvern.

TABLE 2

| Media | D | D | D | D | D | D | E | E | F | G | G |
|---|---|---|---|---|---|---|---|---|---|---|---|
| (vol.) % media | 40 | 45 | 49 | 50 | 52 | 56 | 48 | 52 | 52 | 48 | 52 |
| % <2 μm | 80 | 88 | 90 | 92 | 92 | 94 | 82 | 89 | 91 | 56 | 89 |
| % <1 μm | 56 | 63 | 63 | 65 | 64 | 66 | 57 | 61 | 62 | 83 | 62 |
| $d_{50}$ (μm) | 0.88 | 0.76 | 0.77 | 0.74 | 0.76 | 0.76 | 0.89 | 0.80 | 0.81 | 0.78 | 0.79 |
| Steepness ($d_{30}/d_{70}$) | 3.16 | 2.82 | 2.65 | 2.59 | 2.56 | 2.42 | 3.00 | 2.76 | 2.51 | 2.63 | — |

Example 3

Pilot scale grinding experiments were conducted using an 18.5 kW bottom screen sand grinder.

The grinding media tested were media A and F described above. The grinding media were first conditioned by grinding with a water flush until the wash was clear.

The compositions being ground comprised Raymond calcium carbonate milled flour from Marmara, Turkey. The compositions were targeted to 75% solids slurry dispersed with Dispex 2695 from Ciba.

The flow from the screen was pumped directly back to the grinder feed. The specific energy input was 200 kWh/t. The grind chamber contained 92 liters of media, and 87 liters of slurry.

Figure 6:
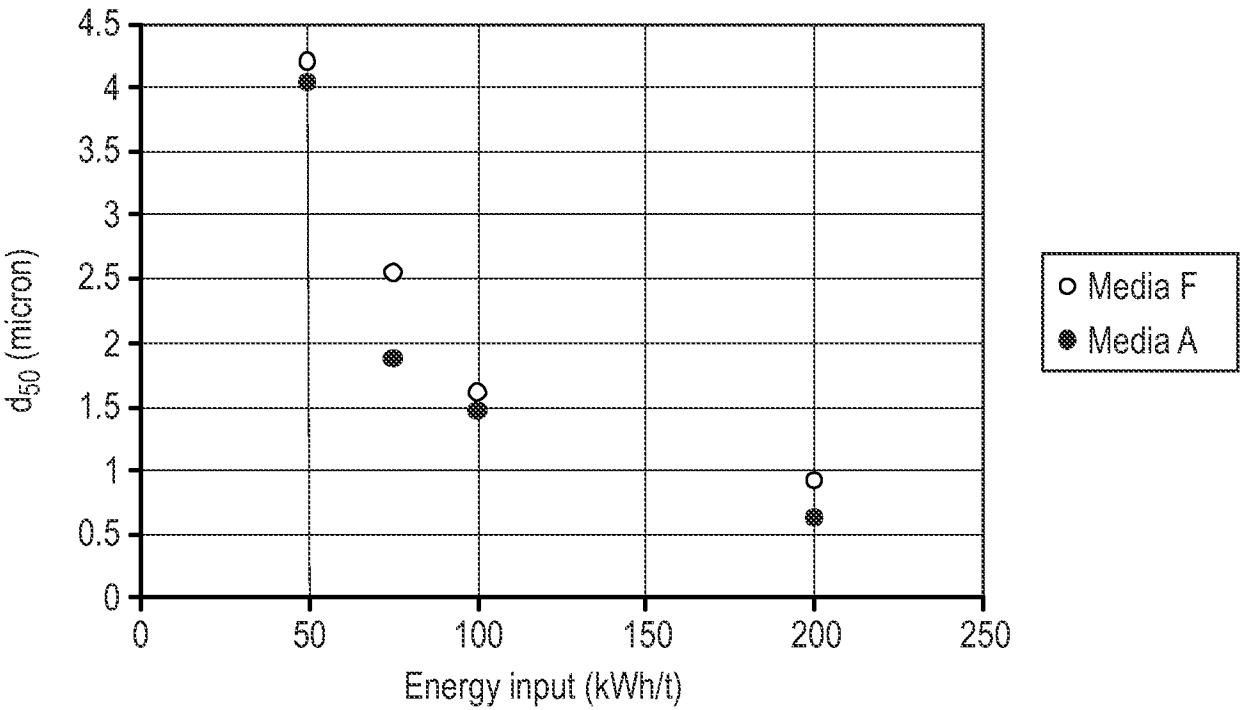
FIG. 6 is a graph showing the $d_{50}$ (in microns) of a particulate calcium carbonate ground using a grinding media comprising rod-shaped particles and a grinding media comprising a conventional grinding media.
Figure 7:
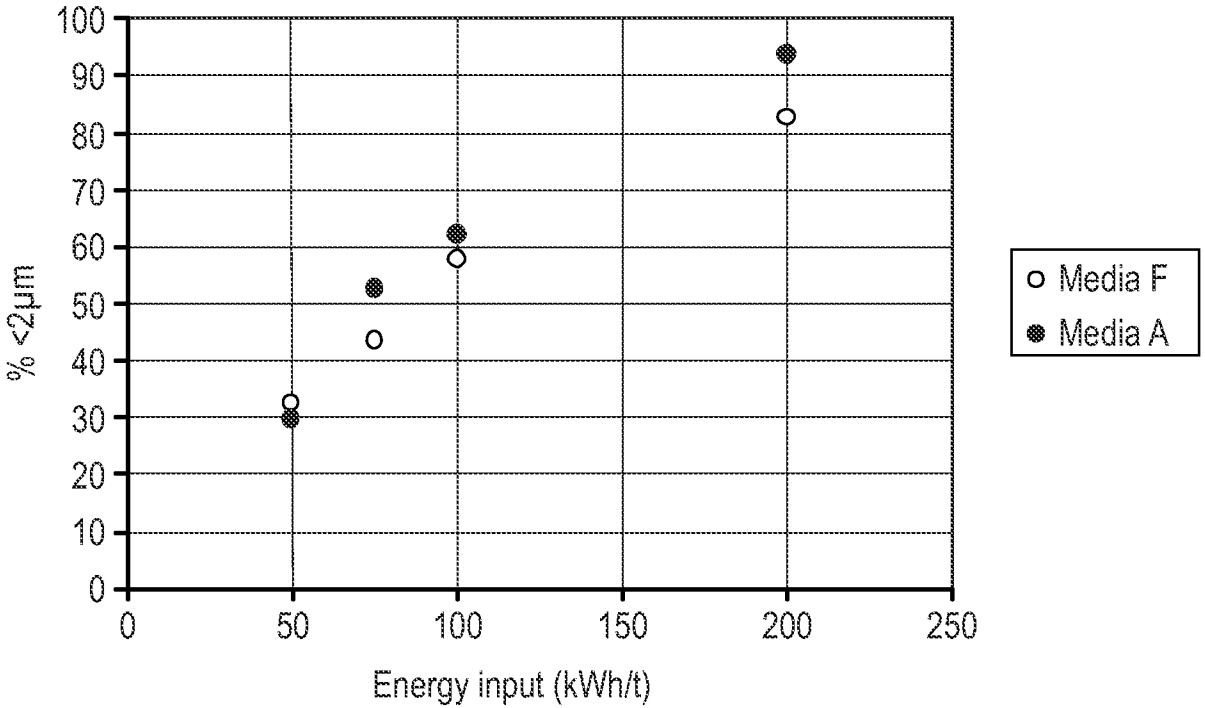
FIG. 7 is a graph showing the percentage of particulate calcium carbonate ground to a $d_{50}$ less than 2 μm using a grinding media comprising rod-shaped particles and a grinding media comprising a conventional grinding media.

The results from the experiments are shown in Table 3 below showing PSD (Sedigraph) as a function of grinding energy, and FIGS. 6 and 7.

TABLE 3

| Media | A | | | | F | | | |
|---|---|---|---|---|---|---|---|---|
| kWh/t | 50 | 75 | 100 | 200 | 50 | 75 | 100 | 200 |
| $d_{30}$ (μm) | 2.03 | 0.97 | 0.78 | 0.34 | 1.76 | 1.17 | 0.82 | 0.52 |
| $d_{50}$ (μm) | 4.05 | 1.86 | 1.46 | 0.63 | 4.20 | 2.55 | 1.59 | 0.91 |
| $d_{70}$ (μm) | 7.06 | 3.13 | 2.44 | 1.04 | 9.51 | 4.87 | 2.84 | 1.46 |
| % <2 μm | 29.7 | 52.5 | 61.9 | 93.7 | 32.5 | 43.4 | 57.6 | 82.7 |
| Abrasion | 24 | 25 | 20 | 8.2 | 52 | 31 | 22 | 16 |
| Solids (%) | 67 | 69.5 | 69.6 | 58.8 | 69.3 | 68.6 | 69.1 | 68.7 |

Example 4

Pilot scale grinding experiments were conducted using an 18.5 kW bottom screen sand grinder.

The grinding media tested were media A and F described above. The grinding media were first conditioned by grinding with a water flush until the wash was clear.

The feed material being ground comprised a calcium carbonate slurry from Salisbury, UK. The calcium carbonate had the following particle size distribution as measured by Sedigraph: 60% of particles less than 2 μm; 2.0% particles greater than 10 μm.

The flow from the screen was pumped directly back to the grinder feed. The media volume concentration was targeted at 51% by adding 92 liters of media and 87 liters of slurry to the grinding chamber, and then adding a further 15 liters of slurry to account for the residence in the pipe work. All grinds were performed at 75 wt. % solids.

Figure 9:
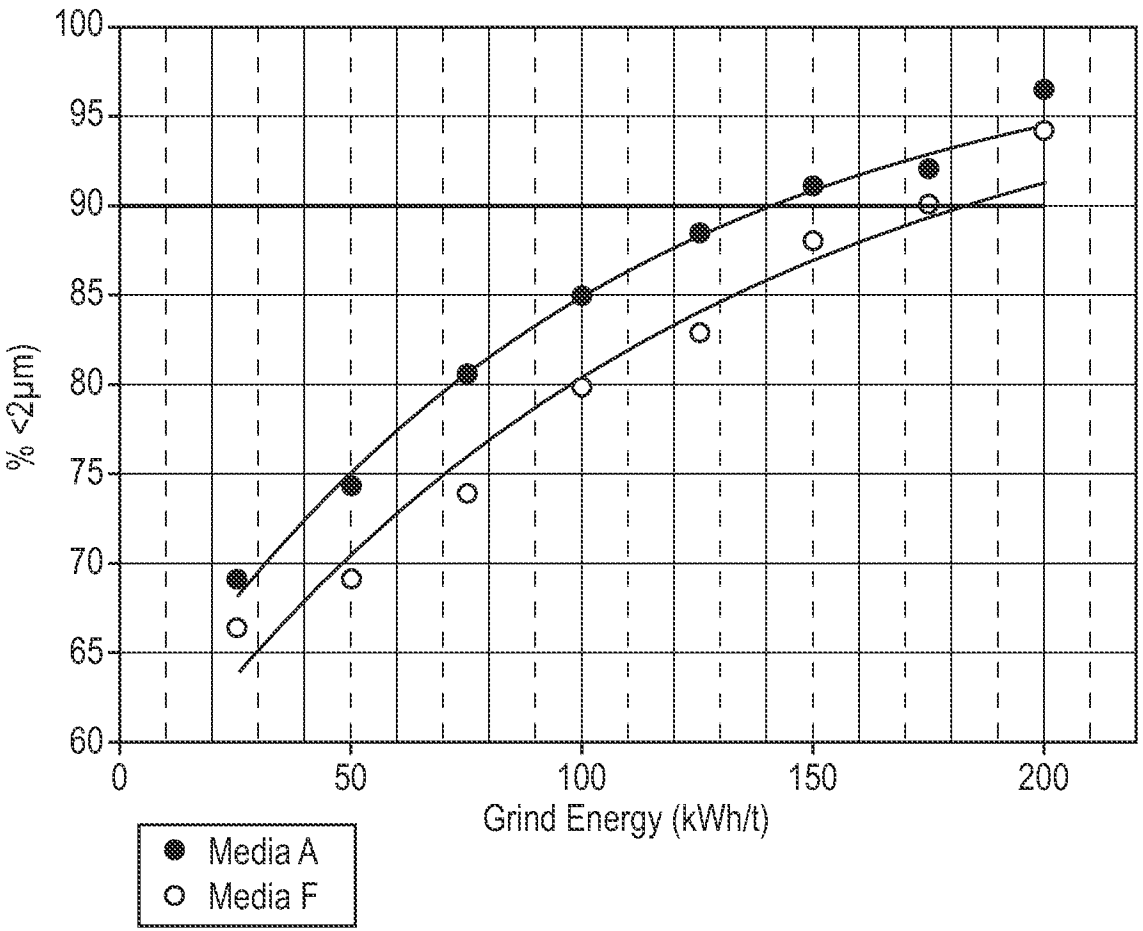
FIG. 9 is a graph showing the percentage of particulate calcium carbonate ground to a $d_{50}$ less than 2 μm using a grinding media comprising rod-shaped particles and a grinding media comprising a conventional grinding media.
Figure 10:
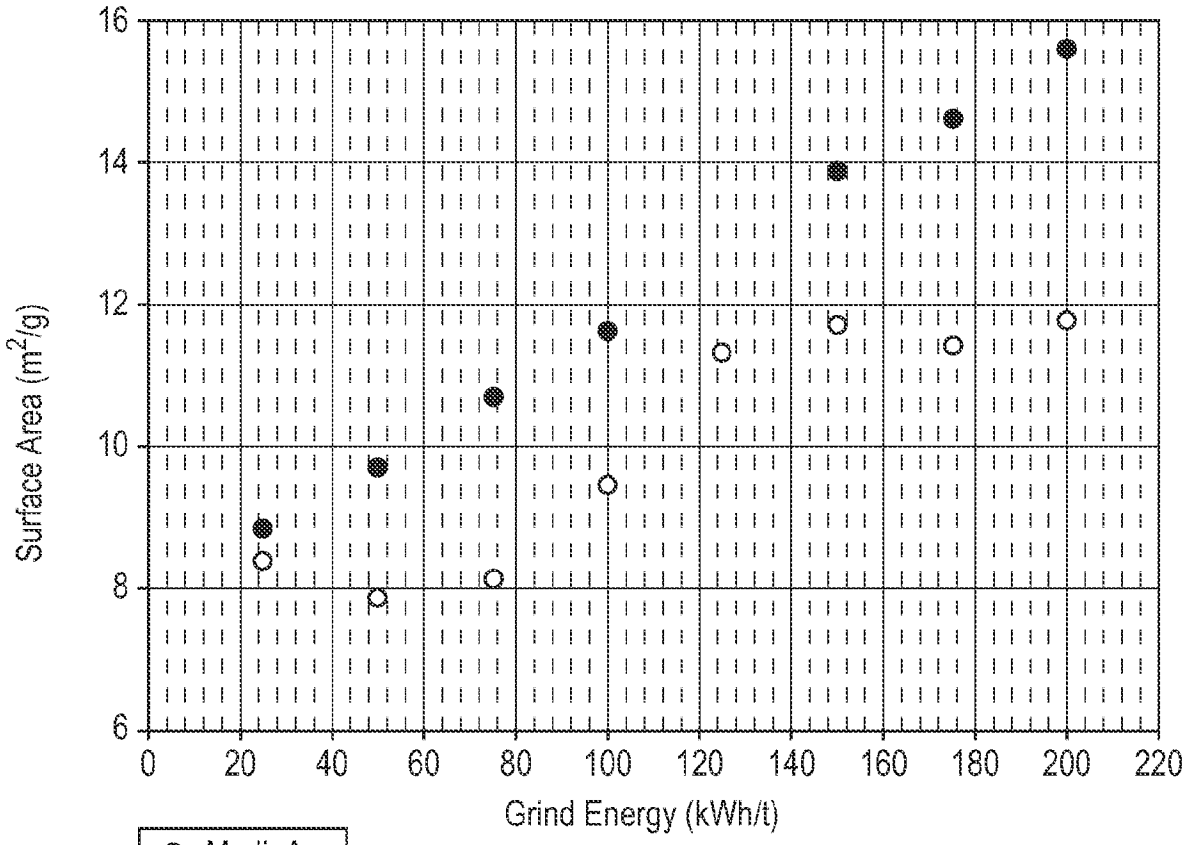
FIG. 10 is a graph showing the relationship between surface are and grinding energy for a particulate calcium carbonate ground using a grinding media comprising rod-shaped particles and a grinding media comprising a conventional grinding media.

The results from the experiments are summarised in FIGS. 8, 9 and 10 below showing PSD (Sedigraph) as a function of grinding energy (FIGS. 8 and 9), and the relationship between surface area and grind energy (FIG. 10).

Figure 8:
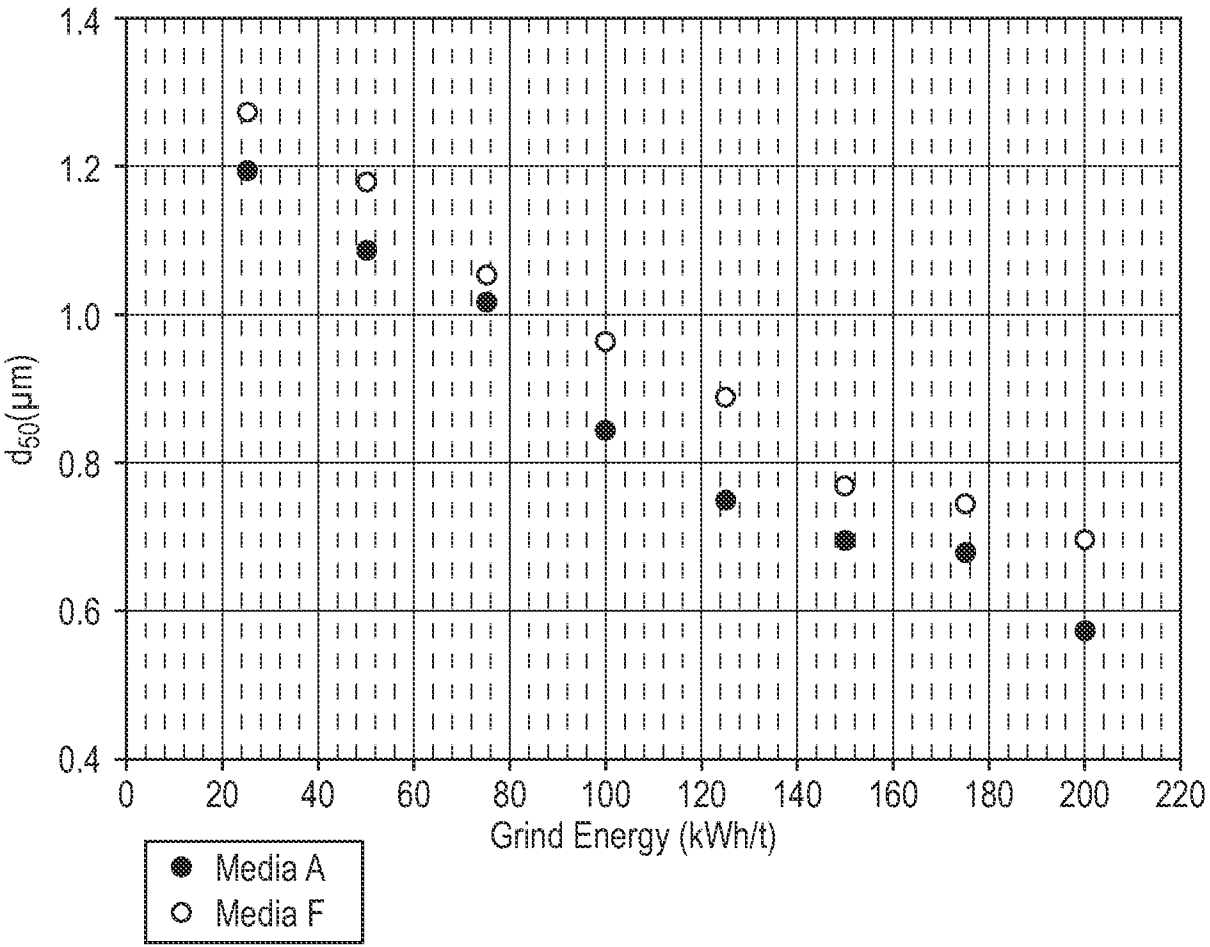
FIG. 8 is showing the $d_{50}$ (in microns) of a particulate calcium carbonate ground using a grinding media comprising rod-shaped particles and a grinding media comprising a conventional grinding media.

FIG. 8 shows that media A (comprising rod-shaped particles having an aspect ratio of at least 2:1) consistently grinds to a finer size than media F (spherical media) for a given energy input.

FIG. 9 shows that media A has a consistently greater efficiency than media F. The line at 90%<2 μm illustrates the different amount of energy required to grind the carbonate slurry such that at least 90 wt. % of the particles are less than 2 μm. Using a media comprising rod-shaped particles having an aspect ratio of at least 2:1 leads to ~20% energy saving.

FIG. 10 demonstrates that not only is there a greater efficiency for surface area production with the grinding media comprising rod-shaped particles, but also that there is a greater linearity in the relationship between surface area and grinding energy.

The entire content of all references cited herein is incorporated by reference for all purposes.

The invention claimed is:

1. A method of grinding an inorganic particulate material, comprising grinding said material in a stirred mill in the presence of a grinding media comprising rod-shaped particles, wherein said rod-shaped particles have an aspect ratio of equal to or greater than about 2:1.

2. A method according to claim 1, wherein the rod-shaped particles have an aspect ratio ranging from about 2:1 to about 10:1.

3. A method according to claim 1, wherein the rod-shaped particles have an aspect ratio ranging from about 2:1 to about 5:1.

4. A method according to claim 1, wherein the rod-shaped particles comprise one or more mineral, ceramic, and/or metallic materials.

5. A method according to claim 4, wherein the rod-shaped particles comprise one or more metal oxide(s).

6. A method according to claim 5, wherein the rod-shaped particles comprise alumina.

7. A method according to claim 6, wherein the alumina content of the rod-shaped particles is greater than about 90 weight % based on the total weight of rod-shaped particles.

8. A method according to claim 4, wherein the rod-shaped particles comprise mullite.

9. A method according to claim 8, wherein the rod-shape particles comprise a blend of mullite and corundum or silicate.

10. A method according to claim 4, wherein the rod-shaped particles comprise a zirconia based ceramic.

11. A method according to claim 1, wherein said inorganic particulate material is selected from a mineral and a metal ore.

12. A method according to claim 1, wherein said inorganic particulate material comprises an alkaline earth metal carbonate.

13. A method according to claim 1, wherein said inorganic particulate material comprises a clay.

14. A method according to claim 1, wherein said inorganic particulate material comprises kaolinite.

15. A method according to claim 1, wherein said inorganic particulate material comprises a mineral selected from talc gypsum, mica, wollastonite, quartz, bauxite, magnesium carbonate, andalusite, barite, diatomaceous earth, and dolomite.

16. A method according to claim 1, wherein the particulate material is in the form of a slurry, and wherein the grinding media comprising rod-shaped particles is present in the stirred mill at a media to slurry ratio ranging from about 40:60 to about 60:40.

17. A method according to claim 1, wherein the rod-shaped particles have an axial length less than about 3 mm.

18. A method according to claim 1, wherein the stirred mill is selected from a tower mill, a Sala agitated mill (SAM), an ISA mill, and a stirred media detritor (SMD).

19. A method according to claim 1, wherein the rod-shaped particles have an aspect ratio equal to or greater than about 3:1.

20. A method according to claim 1, wherein said grinding comprises wet grinding.

21. A method according to claim 1, wherein said grinding comprises dry grinding.

* * * * *

UNITED STATES PATENT AND TRADEMARK OFFICE

CERTIFICATE OF CORRECTION

PATENT NO. : 8,783,589 B2
APPLICATION NO. : 13/123266
DATED : July 22, 2014
INVENTOR(S) : Jarrod Hart et al.

It is certified that error appears in the above-identified patent and that said Letters Patent is hereby corrected as shown below:

In the Claims:

Claim 9, col. 13, lines 9-10, "rod-shape particles" should read -- rod-shaped particles --.

Signed and Sealed this
Seventh Day of October, 2014

Michelle K. Lee

Michelle K. Lee
*Deputy Director of the United States Patent and Trademark Office*